US008633656B2

(12) United States Patent
Wu et al.

(10) Patent No.: US 8,633,656 B2
(45) Date of Patent: Jan. 21, 2014

(54) DRIVING CIRCUIT AND DRIVING METHOD OF BACKLIGHT MODULE OF DISPLAY APPARATUS

(75) Inventors: Mei-Hao Wu, Shenzhen (CN); Chingyuan Yang, Shenzhen (CN)

(73) Assignee: Shenzhen China Star Optoelectronics Technology Co., Ltd., Guangdong (CN)

( * ) Notice: Subject to any disclaimer, the term of this patent is extended or adjusted under 35 U.S.C. 154(b) by 293 days.

(21) Appl. No.: 13/219,602

(22) Filed: Aug. 26, 2011

(65) Prior Publication Data

US 2012/0091908 A1 Apr. 19, 2012

(51) Int. Cl.
*H05B 37/00* (2006.01)

(52) U.S. Cl.
USPC ..... 315/291; 315/224; 315/307

(58) Field of Classification Search
USPC ..... 315/224, 291, 307, 308, 227 R, 240, 315/241 R, 243, 244, 246
See application file for complete search history.

(56) References Cited

U.S. PATENT DOCUMENTS

| | | | | |
|---|---|---|---|---|
| 7,391,166 | B2 * | 6/2008 | Ushijima et al. | 315/276 |
| 7,548,028 | B2 * | 6/2009 | Ushijima | 315/244 |

FOREIGN PATENT DOCUMENTS

| | | | |
|---|---|---|---|
| CN | 1540608 | A | 10/2004 |
| CN | 101083863 | A | 12/2007 |
| CN | 101727831 | A | 6/2010 |
| WO | 2009001409 | A1 | 12/2008 |

* cited by examiner

*Primary Examiner* — David H Vu

(57) ABSTRACT

The present invention provides a driving circuit and a driving method of a backlight module of a display apparatus. The driving method comprises the following steps: utilizing a phase detector to detect voltage phases of an inductor and a capacitor of a resonant circuit; utilizing a frequency adjusting module to obtain an operation frequency according to a phase detection signal; and utilizing a driving chip to drive a DC-to-AC power stage circuit according to the operation frequency. The invention can improve the transformation efficiency of the driving circuit.

17 Claims, 4 Drawing Sheets

DRIVING CIRCUIT AND DRIVING METHOD OF BACKLIGHT MODULE OF DISPLAY APPARATUS

FIELD OF THE INVENTION

The present invention relates to a driving circuit and a driving method of a backlight module of a display apparatus, and more particularly to a driving circuit and a driving method of a backlight module of a display apparatus capable of improving the circuit efficiency.

BACKGROUND OF THE INVENTION

Liquid crystal displays (LCDs) have been widely applied in electrical products. Currently, most of LCDs are backlight type LCDs which comprise a liquid crystal panel and a backlight module. According to the position of the backlight source, the backlight module can be a side-light type or a direct-light type in order to provide LCDs with backlight.

Light emitting diodes (LEDs) have several beneficial characteristics, including low electrical power consumption, low heat generation, long operational life, small volume, good impact resistance, fast response and excellent stability for emitting color light with stable wavelengths. These characteristics have made the LEDs suitable for light sources of the backlight module.

Currently, a resonant circuit has been used in an LED backlight module to be a driving circuit of LEDs. The conventional resonant circuit controls a load (such as LED) with a fixed frequency. However, the load may be varied, and alternatively, the load characteristic of the load may be considerably varied for long-term utilization. Therefore, the resonant driving circuit using the fixed frequency can not be operated in the optimum status. Furthermore, when the material of a bezel of the backlight module is metal, a parasitic capacitance of the backlight module may also affect the parameter, thus deteriorating the entire operation of the circuit. Accordingly, the circuit can also not be operated in the optimum status.

As a result, it is necessary to provide a driving circuit and a driving method of a backlight module of a display apparatus to solve the problems existing in the conventional technologies, as described above.

SUMMARY OF THE INVENTION

A primary object of the present invention is to provide a backlight module, and the backlight module comprises: a back bezel; a plurality of light emitting diodes disposed on the back bezel; and a driving circuit electrically connected to the light emitting diodes, wherein the driving circuit comprises: a direct-current to alternating-current power stage circuit; a resonant circuit electrically connected to the direct-current to alternating-current power stage circuit; a phase detector electrically connected to the resonant circuit and configured to detect voltage phases of an inductor and a capacitor of the resonant circuit and transmit a phase detection signal; a frequency adjusting module electrically connected to the phase detector and configured to obtain an operation frequency according to the phase detection signal; and a driving chip electrically connected to the frequency adjusting module and configured to drive the direct-current to alternating-current power stage circuit according to the operation frequency, wherein the operation frequency is equal to a resonant frequency of the resonant circuit.

Another object of the present invention is to provide a driving circuit of a backlight module, and the driving circuit comprises: a direct-current to alternating-current power stage circuit; a resonant circuit electrically connected to the direct-current to alternating-current power stage circuit; a phase detector electrically connected to the resonant circuit and configured to detect voltage phases of an inductor and a capacitor of the resonant circuit and transmit a phase detection signal; a frequency adjusting module electrically connected to the phase detector and configured to obtain an operation frequency according to the phase detection signal; and a driving chip electrically connected to the frequency adjusting module and configured to drive the direct-current to alternating-current power stage circuit according to the operation frequency.

A further object of the present invention is to provide a driving method of a backlight module, and the driving circuit comprises a resonant circuit, a frequency adjusting module and a direct-current to alternating-current power stage circuit, and the method comprises the following steps: detecting voltage phases of an inductor and a capacitor of the resonant circuit and transmitting a phase detection signal; utilizing the frequency adjusting module to obtain an operation frequency according to the phase detection signal; and driving the direct-current to alternating-current power stage circuit according to the operation frequency.

In one embodiment of the present invention, the resonant circuit is a series resonant circuit or a parallel resonant circuit.

In one embodiment of the present invention, the frequency adjusting module adjusts the operation frequency according to the phase detection signal.

In one embodiment of the present invention, the operation frequency is close to or equal to a resonant frequency of the resonant circuit.

In one embodiment of the present invention, the phase detection signal is provided by a phase detector, and the phase detector is configured to detect the voltage phases of the inductor and the capacitor of the resonant circuit and transmit the phase detection signal.

In one embodiment of the present invention, the phase detector calculates and obtains an optimum operation frequency according to a voltage phase difference between the inductor and the capacitor, and the frequency adjusting module adjusts the operation frequency to the optimum operation frequency.

The driving circuit and the driving method of the backlight module of the display apparatus of the present invention can utilize the resonant circuit to drive the LED backlight module, and real-time regulate the operation frequency of the circuit in accordance with the load status thereof, thereby raising the transformation efficiency of the driving circuit.

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1:
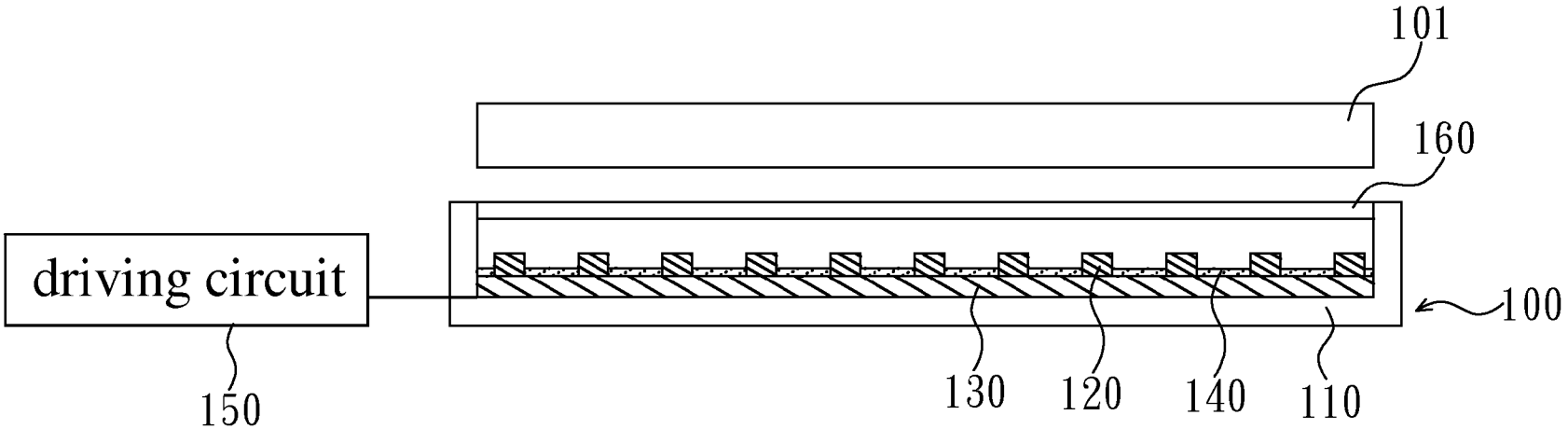
FIG. 1 is a cross-sectional view showing a backlight module and a display panel according to an embodiment of the present invention.

The following embodiments are referring to the accompanying drawings for exemplifying specific implementable embodiments of the present invention. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto.

In the drawings, structure-like elements are labeled with like reference numerals.

Referring to FIG. 1, a cross-sectional view showing a backlight module and a display panel according to an embodiment of the present invention is illustrated. The backlight module 100 of the present embodiment may be realized as a side-light type backlight module or a direct-light type backlight module disposed opposite to a display panel 101 (such as an LCD panel), thereby forming a display apparatus (such an LCD apparatus). In this embodiment, the backlight module 100 may be the direct-light type backlight module which comprises a back bezel 110, a plurality of light emitting diodes (LEDs) 120, a circuit board 130, a reflective layer 140, a driving circuit 150 and at least one optical film 160. The circuit board 130 is disposed on the back bezel 110. The LEDs 120 are disposed on the circuit board 130 and electrically connected thereto for emitting light to the display panel 101. The reflective layer 140 is formed around the LEDs 120 (such as formed on the circuit board 130 or the back bezel 110) for reflecting the light of the LEDs 120. The driving circuit 150 is electrically connected to LEDs 120 for driving the LEDs 120 to emit light. The optical film 160 is disposed above the LEDs 120 for improving the light uniformity and light efficiency thereof.

Referring to FIG. 1 again, the back bezel 110 of the present embodiment may be made of an opaque material, such as plastic, metal or any combination material thereof for carrying the LEDs 120 and the circuit board 130. The LEDs 120 are disposed on the circuit board 130 and electrically connected to the driving circuit 150 through the circuit board 130. The circuit board 130 may be a printed circuit board (PCB) or a flexible printed circuit (FPC). The reflective layer 140 may be a reflective sheet, a reflective film or a reflective coated layer formed between or around the LEDs 120 for reflecting light. The reflective layer 140 may be made of a highly reflective material, such as Ag, Al, Au, Cr, Cu, In, Ir, Ni, Pt, Re, Rh, Sn, Ta, W, Mn, any alloy combination thereof, white reflective paint with etiolation-resistant and heat-resistant properties or any combination thereof for reflecting the light of the LEDs 120. The optical film 160 may be for example a diffuser, a prism sheet, a turning prism sheet, a brightness enhancement film, a dual brightness enhancement film, a diffused reflective polarizer film or any combination thereof disposed above the LEDs 120.

Figure 2:
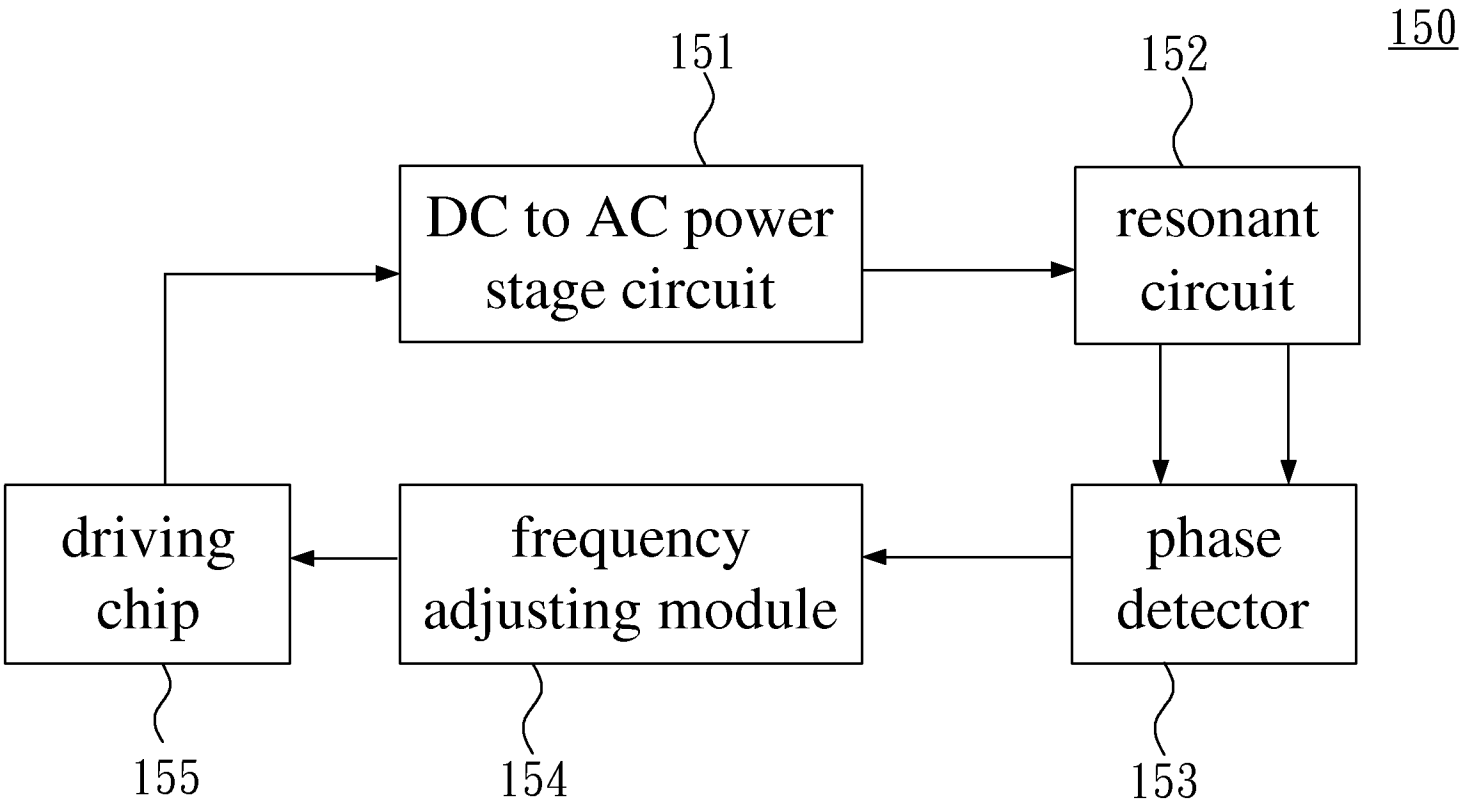
FIG. 2 is a block diagram showing the driving circuit according to an embodiment of the present invention.
Figure 3:
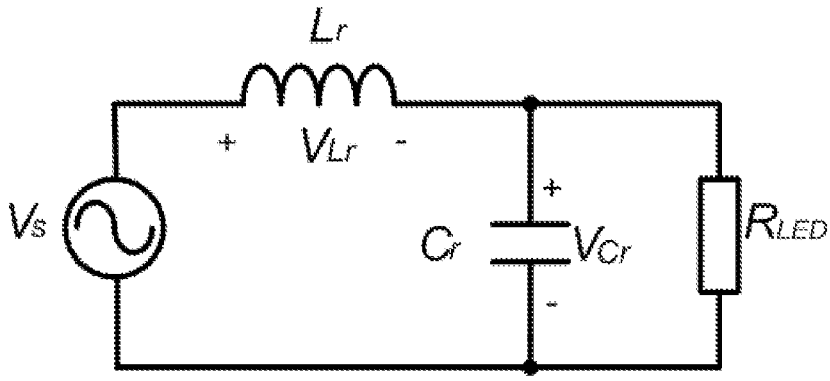
FIG. 3 is an equivalent circuit diagram showing a resonant circuit and a load according to an embodiment of the present invention.

Referring to FIG. 2 and FIG. 3, FIG. 2 is a block diagram showing the driving circuit according to an embodiment of the present invention, FIG. 3 is an equivalent circuit diagram showing a resonant circuit and a load according to an embodiment of the present invention. The driving circuit 150 of the present embodiment may comprise a direct-current to alternating-current (DC to AC) power stage circuit 151, a resonant circuit 152, a phase detector 153, a frequency adjusting module 154 and a driving chip 155. The DC to AC power stage circuit 151 is configured to convert a DC power into an AC voltage for driving the LEDs 120. The resonant circuit 152 is electrical connected to the DC to AC power stage circuit 151. In the present embodiment, referring to FIG. 3, the resonant circuit 152 can transform an AC square wave into an AC sinusoidal wave using a series resonant parallel loaded (SRPL) manner for driving the LEDs 120. The resonant circuit 152 can include an inductor Lr and a capacitor Cr. The inductor Lr is connected between the AC voltage Vs and the capacitor Cr in series, i.e. the resonant circuit 152 is a series resonant circuit. The AC voltage Vs is transformed into the AC square-wave form by the switching of the DC to AC power stage circuit 151. The capacitor Cr is connected to the LEDs 120 (the load $R_{LED}$) in parallel.

In one embodiment, the resonant circuit 152 may also be a parallel resonant circuit.

Referring to FIG. 2 again, the resonant circuit 152 of the driving circuit 150 can implement a wave filtering for the AC square wave with an operation frequency $f_s(\omega_s)$ by using a resonant energy-tank, and form a high-frequency AC sinusoidal wave at the load terminal. A natural frequency formed by the resonant energy-tank is regarded as a resonant frequency $f_o(\omega_o)$.

Figure 4:
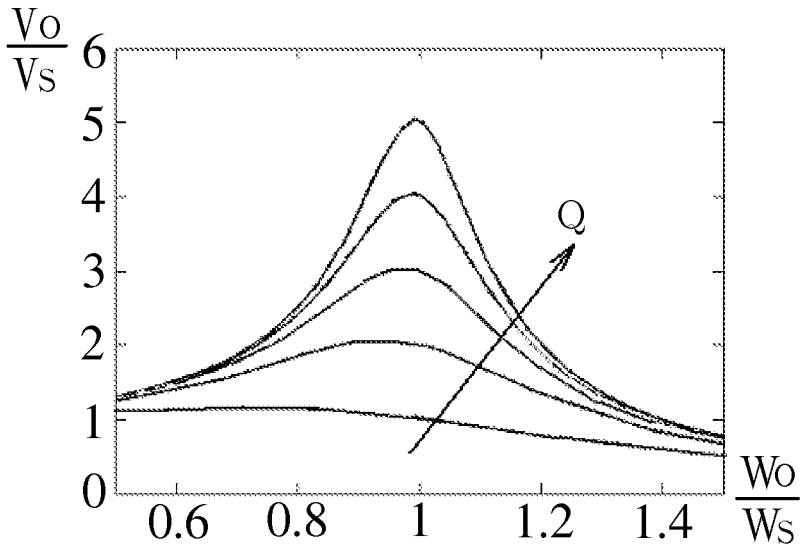
FIG. 4 is a characteristic curve diagram showing a relation between a voltage gain and the operation frequency of the resonant circuit according to an embodiment of the present invention.

Referring to FIG. 4, a characteristic curve diagram showing a relation between a voltage gain and the operation frequency of the resonant circuit according to an embodiment of the present invention is illustrated, wherein the diagram is plotted with a ratio between the resonant frequency and the operation frequency ($\omega_o/\omega_s$) as the horizontal axis and the voltage gain ratio (Vo/Vs) as the ordinate. As shown in this diagram, when the operation frequency $f_s(\omega_s)$ is close to or substantially equal to the resonant frequency $f_o(\omega_o)$, the voltage gain can be approximate to the following equation (1):

$$\left|\frac{V_o(j\omega)}{V_s(j\omega)}\right| \cong Q, \tag{1}$$

and the quality factor Q can be represented as the following equation (2):

$$Q = R_{LED} \Big/ \sqrt{\frac{L_r}{C_r}} \tag{2}$$

As shown in the above-mentioned equations (1) and (2), at the time when the gain value of the resonant circuit 152 is approximate to the infinity, i.e. the resonant circuit 152 is regarded as a pure resistor type, the resonant circuit 152 can have an optimum transformation efficiency. However, in the actual operation situation, when the characteristic of the load is varied, or when the back bezel 110 made of metal has the parasitic capacitance, the resonant frequency $f_o(\omega_o)$ of the resonant circuit 152 is susceptible to be varied. At this time, if the operation frequency $f_s(\omega_s)$ is invariable, the operation frequency $f_s(\omega_s)$ can not be approximate to the resonant frequency $f_o(\omega_o)$, and thus the resonant circuit 152 can not regarded as the pure resistor type, resulting in the deterioration of the transformation efficiency. For example, before and after lighting the LEDs 120 (the load), the load characteristic thereof is different. Therefore, if the operation frequency is a fixed value, the resonant circuit 152 can not have the optimum value.

Referring to FIG. 2 again, the phase detector 153 of the driving circuit 150 of the present embodiment is electrically connected to the resonant circuit 152 and configured to detect voltage phases $V_{Lr}$, $V_{Cr}$ of the inductor Lr and the capacitor Cr of the resonant circuit 152 and transmit the detected result (a phase detection signal) to the frequency adjusting module 154. In one embodiment, the phase detector 153 can detect the voltage phases $V_{Lr}$, $V_{Cr}$ of the inductor Lr and the capacitor Cr, and determine that the load is an inductor type or a capacitor type according to a voltage phase difference between the voltage phases $V_{Lr}$, $V_{Cr}$, and then transmit the determined result (the phase detection signal) to the frequency adjusting module 154. The frequency adjusting module 154 is electrically connected to the phase detector 153 and configured to obtain the operation frequency $f_s(\omega_s)$ according to the phase detection signal. The frequency adjusting module 154 can adjust the operation frequency $f_s(\omega_s)$ according to the calculated result of the phase detector 153, and then transmit the adjusted result to the driving chip 155. The driving chip 155 is electrically connected between the frequency adjusting module 154 and the DC to AC power stage circuit 151. The driving chip 155 can utilize the calculated operation frequency $f_s(\omega_s)$ to drive the switch of the DC to AC power stage circuit 151.

In one embodiment, the phase detector 153 can detect the voltage phases $V_{Lr}$, $V_{Cr}$ of the inductor Lr and the capacitor Cr of the resonant circuit 152, and can calculate and obtain an optimum operation frequency (for example substantially equal to the resonant frequency) according to the voltage phase difference between the voltage phases $V_{Lr}$, $V_{Cr}$, and then transmit the calculated result (the phase detection signal) to the frequency adjusting module 154. In this way, the frequency adjusting module 154 can adjust the operation frequency $f_s(\omega_s)$ to the optimum operation frequency.

Therefore, the driving circuit of the backlight module of the present embodiment can regulate the operation frequency $f_s(\omega_s)$ by detecting the voltage phases $V_{Lr}$, $V_{Cr}$ of the inductor Lr and the capacitor Cr of the resonant circuit 152, so as to allow the operation frequency $f_s(\omega_s)$ to be close to or substantially equal to the resonant frequency $f_o(\omega_o)$. In this way, the entire circuit can be operated as the pure resistor type load for raising the entire transformation efficiency.

Figure 5:
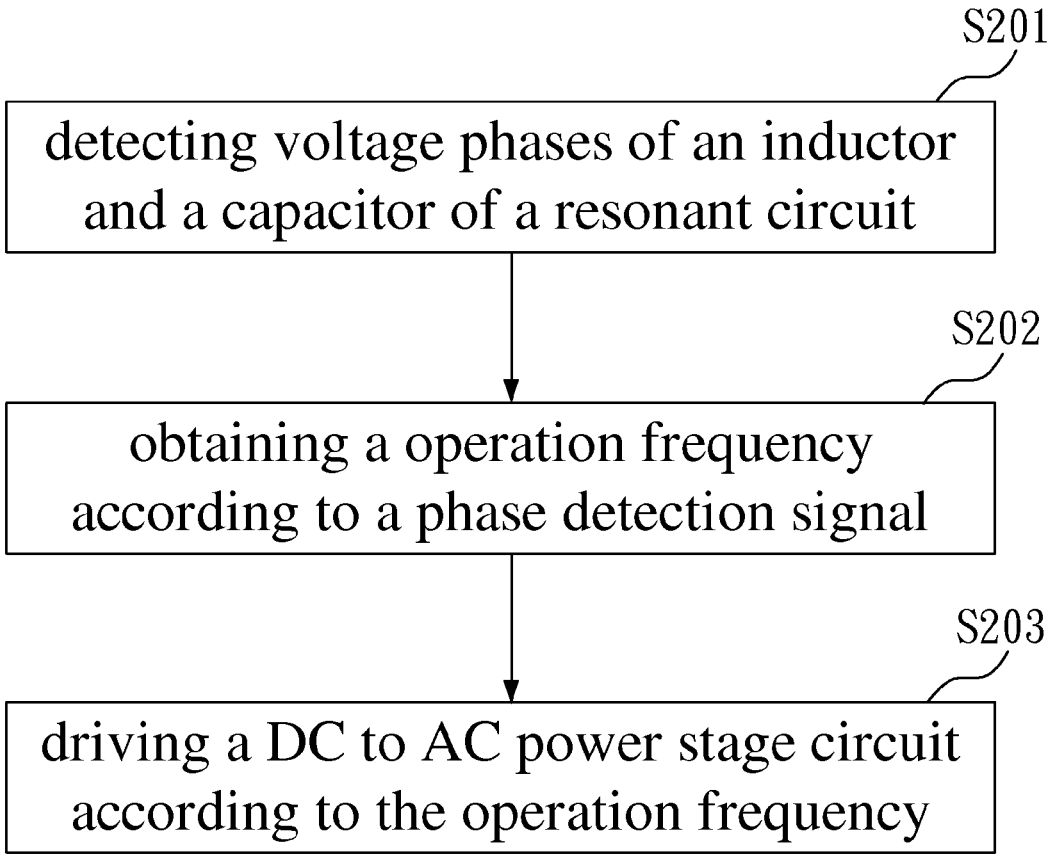
FIG. 5 is a flow diagram showing a driving method for driving the backlight module according to an embodiment of the present invention.

Referring to FIG. 5, a flow diagram showing a driving method for driving the backlight module according to an embodiment of the present invention is illustrated. When implementing the driving method of the backlight module 100, the phase detector 153 of the driving circuit 150 can detect the voltage phases $V_{Lr}$, $V_{Cr}$ of the inductor Lr and the capacitor Cr of the resonant circuit 152, and then transmit the phase detection signal (the detected result) to the frequency adjusting module 154 (step S201). Subsequently, the frequency adjusting module 154 can calculate and obtain the corresponding operation frequency $f_s(\omega_s)$ according to the phase detection signal, and can transmit a adjusted result to the driving chip 155 (step S202). Subsequently, the driving chip 155 can drive the DC to AC power stage circuit 151 according to the adjusted operation frequency $f_s(\omega_s)$ (step S203).

As described above, the driving circuit and the driving method of the backlight module of the display apparatus of the present invention can real-time control the driving of the backlight module according to the load status of the circuit. Therefore, the driving circuit and the driving method of the present invention can utilize the resonant circuit to drive the LED backlight module, and regulate the operation frequency by detecting the voltage phases of the inductor and the capacitor. In this way, the driving circuit of the backlight module can be operated in the optimum status at any time, thus raising the transformation efficiency of the driving circuit.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A backlight module, wherein the backlight module comprises:
- a back bezel;
- a plurality of light emitting diodes disposed on the back bezel; and
- a driving circuit electrically connected to the light emitting diodes, wherein the driving circuit comprises:
- a direct-current to alternating-current power stage circuit;
- a resonant circuit electrically connected to the direct-current to alternating-current power stage circuit;
- a phase detector electrically connected to the resonant circuit and configured to detect voltage phases of an inductor and a capacitor of the resonant circuit and transmit a phase detection signal;
- a frequency adjusting module electrically connected to the phase detector and configured to obtain an operation frequency according to the phase detection signal; and
- a driving chip electrically connected to the frequency adjusting module and configured to drive the direct-current to alternating-current power stage circuit according to the operation frequency, wherein the operation frequency is equal to a resonant frequency of the resonant circuit.

2. The backlight module according to claim 1, wherein the resonant circuit is a series resonant circuit.

3. The backlight module according to claim 1, wherein the resonant circuit is a parallel resonant circuit.

4. The backlight module according to claim 1, wherein the frequency adjusting module adjusts the operation frequency according to the phase detection signal of the phase detector.

5. The backlight module according to claim 1, wherein the phase detector calculates and obtains an optimum operation frequency according to a voltage phase difference between the inductor and the capacitor, and the frequency adjusting module adjusts the operation frequency to the optimum operation frequency.

6. A driving circuit of a backlight module, wherein the driving circuit comprises:
- a direct-current to alternating-current power stage circuit;
- a resonant circuit electrically connected to the direct-current to alternating-current power stage circuit;
- a phase detector electrically connected to the resonant circuit and configured to detect voltage phases of an inductor and a capacitor of the resonant circuit and transmit a phase detection signal;
- a frequency adjusting module electrically connected to the phase detector and configured to obtain an operation frequency according to the phase detection signal; and
- a driving chip electrically connected to the frequency adjusting module and configured to drive the direct-current to alternating-current power stage circuit according to the operation frequency.

7. The driving circuit according to claim 6, wherein the resonant circuit is a series resonant circuit.

8. The driving circuit according to claim 6, wherein the resonant circuit is a parallel resonant circuit.

9. The driving circuit according to claim 6, wherein the frequency adjusting module adjusts the operation frequency according to the phase detection signal of the phase detector.

10. The driving circuit according to claim 6, wherein the operation frequency is equal to a resonant frequency of the resonant circuit.

11. The driving circuit according to claim 6, wherein the phase detector calculates and obtains an optimum operation frequency according to a voltage phase difference between the inductor and the capacitor, and the frequency adjusting module adjusts the operation frequency to the optimum operation frequency.

12. A driving method of a backlight module, wherein the driving circuit comprises a resonant circuit, a frequency adjusting module and a direct-current to alternating-current power stage circuit, and the method comprises the following steps:

detecting voltage phases of an inductor and a capacitor of the resonant circuit and transmitting a phase detection signal;

utilizing the frequency adjusting module to obtain an operation frequency according to the phase detection signal; and driving the direct-current to alternating-current power stage circuit according to the operation frequency.

13. The method according to claim 12, wherein the resonant circuit is a series resonant circuit.

14. The method according to claim 12, wherein the resonant circuit is a parallel resonant circuit.

15. The method according to claim 12, wherein the phase detection signal is provided by a phase detector, and the phase detector is configured to detect the voltage phases of the inductor and the capacitor of the resonant circuit and transmit the phase detection signal.

16. The method according to claim 15, wherein the phase detector calculates and obtains an optimum operation frequency according to a voltage phase difference between the inductor and the capacitor, and the frequency adjusting module adjusts the operation frequency to the optimum operation frequency.

17. The method according to claim 12, wherein the operation frequency is equal to a resonant frequency of the resonant circuit.

* * * * *